US005525244A

United States Patent [19]

Turner et al.

[11] Patent Number: 5,525,244

[45] Date of Patent: Jun. 11, 1996

[54] RINSE CONDITIONER

[75] Inventors: Graham A. Turner, Bromborough; Sigrun Eriksen, Spital, both of United Kingdom

[73] Assignee: Levers Brothers Company, Division of Conopco, Inc., New York, N.Y.

[ * ] Notice: The term of this patent shall not extend beyond the expiration date of Pat. No. 5,403,500.

[21] Appl. No.: 327,729

[22] Filed: Oct. 24, 1994

Related U.S. Application Data

[63] Continuation of Ser. No. 53,576, Apr. 27, 1993, abandoned.

[30] Foreign Application Priority Data

Apr. 28, 1992 [GB] United Kingdom ..... 9209170

[51] Int. Cl.[6] ..... D06M 13/46

[52] U.S. Cl. ..... 252/8.8; 252/8.6; 252/8.9

[58] Field of Search ..... 252/8.6, 8.8, 8.9

[56] References Cited

U.S. PATENT DOCUMENTS

| | | | |
|---|---|---|---|
| 4,137,180 | 1/1979 | Naik et al. | 252/8.8 |
| 4,427,558 | 1/1984 | David | 252/8.8 |
| 4,429,859 | 2/1984 | Steiner et al. | 252/8.8 |
| 4,589,989 | 5/1986 | Muller et al. | 252/8.75 |
| 4,767,547 | 8/1988 | Straathof et al. | 252/8.8 |
| 4,769,159 | 9/1988 | Copeland | 252/8.8 |
| 4,954,270 | 9/1990 | Butterworth et al. | 252/8.8 |
| 4,965,100 | 10/1990 | Leigh et al. | 427/242 |
| 5,089,148 | 2/1992 | Van Blarcom et al. | 252/8.6 |
| 5,093,014 | 3/1992 | Neillie | 252/8.8 |
| 5,116,520 | 5/1992 | Lichtenwalter et al. | 252/8.6 |
| 5,130,035 | 7/1992 | Dell'Armo et al. | 252/8.6 |
| 5,183,580 | 2/1993 | Lew et al. | 252/8.6 |
| 5,221,794 | 6/1993 | Ackerman | 548/349.1 |
| 5,403,500 | 4/1995 | Turner | 252/8.8 |
| 5,409,621 | 4/1995 | Ellis et al. | 252/8.8 |
| 5,417,868 | 5/1995 | Turner et al. | 252/8.8 |

FOREIGN PATENT DOCUMENTS

| | | |
|---|---|---|
| 41821 | 12/1981 | European Pat. Off. . |
| 65387 | 11/1982 | European Pat. Off. . |
| 234082 | 9/1987 | European Pat. Off. . |
| 2356627 | 7/1977 | France . |
| 2182972 | 2/1990 | Japan . |
| 8837 | 5/1992 | WIPO . |
| 18593 | 10/1992 | WIPO . |

*Primary Examiner*—Paul Lieberman
*Assistant Examiner*—Michael P. Tierney
*Attorney, Agent, or Firm*—A. Kate Huffman

[57] ABSTRACT

A powdered rinse conditioner comprising a nonionic active water insoluble cationic active having the formula:

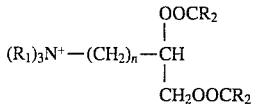

in which $R_1$ is independently selected from $C_{1-4}$ alkyl, hydroxyalkyl, or $C_2$–$C_4$ alkenyl groups and wherein each $R_2$ group is independently selected from $C_{2-27}$ alkyl or alkenyl groups and n is an integer from 0 to 5 and relatively low levels of a long chain alcohol ethoxylate as a nonionic dispersion aid. The rinse conditioner exhibits good softening results when added directly to the wash liquor.

5 Claims, No Drawings

RINSE CONDITIONER

RELATED APPLICATIONS

This application is a continuation-in-part of U.S. Ser. No. 08/053,576, filed on Apr. 27, 1993, now abandoned.

FIELD OF THE INVENTION

This invention relates to rinse conditioners comprising a softening or anti-static component delivered directly to the wash liquor during a rinsing step.

BACKGROUND OF THE INVENTION

In the past, fabric conditioning has been carried out either during the rinsing step of a fabric washing and rinsing process or during tumble drying of the fabric. In almost all cases rinse conditioning is accomplished by adding a liquid dispersion of a rinse conditioning agent to the rinse liquor. The liquid dispersion was traditionally distributed and made available to consumers as a ready-to-use aqueous dispersion. More recently, concern for the environment and consumer convenience has led to the sale of concentrated aqueous dispersions which are either used in smaller amounts or are mixed with water to form a predilute before use as described in Turner, U.S. Ser. No. 08/053,588.

In EP 234082 it has been proposed to supply rinse conditioner as a solid block. This approach requires the use of a special restraint for the block and may also require the modification of the washing machine to enable the block to be dissolved and dispensed by a spray system.

Various proposals have been made to supply fabric softener in granular or powdered form. EP 111074 is typical and uses a silica to carry the softener. A disadvantage of using a carrier such as silica is that it bulks up the product and serves no function beyond making the powder compatible with other ingredients that may be contained in a washing powder.

WO 92/18593 describes a granular fabric softening composition comprising a nonionic fabric softener and a single long alkyl chain cationic material. The specification teaches that effective cationic softening compounds when used in granular form exhibit poor dispersion properties. Moreover, this publication states that the dispersibility problems of powders should be overcome by replacing the cationic softening compound with any number of nonionic softening compounds. Softening is maintained by the nonionic softening compound and the problem of dispersing the cationic compound as a powder is dismissed because less cationic material is used.

For these reasons, despite the obvious environmental and transport-saving advantages of selling a water-free powdered rinse conditioner, manufacturers have not done so.

SUMMARY OF THE INVENTION

It has been unexpectedly discovered that powders having good dispersibility can be prepared with a large amount of cationic material when combined with only a low amount of nonionic dispersion aid. Unnecessarily high levels of nonionic dispersion aid are not required to provide good dispersible powders since softening is effective from the cationic alone without the need for additional noncationic softening materials.

The present invention provides a powdered rinse conditioner and method of using it comprising:

a) a water insoluble cationic active having the formula:

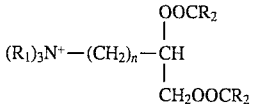

wherein each $R_1$ is independently selected from $C_{1-4}$ alkyl, hydroxyalkyl or $C_2$–$C_4$ alkenyl groups; and wherein each $R_2$ group is independently selected from $C_{2-27}$ alkyl or alkenyl groups and n is an integer from 0–5, and b) a nonionic dispersing agent.

DETAILED DESCRIPTION OF THE PREFERRED EMBODIMENTS

According to the present invention, there is provided a powdered rinse conditioner for direct application to the rinse load comprising a water insoluble cationic active of the formula:

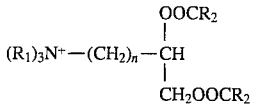

wherein each $R_1$ group is independently selected from $C_{1-4}$ alkyl, hydroxyalkyl or $C_2$–$C_4$ alkenyl groups; and wherein each $R_2$ group is independently selected from $C_{2-27}$ alkyl or alkenyl groups and n is an integer from 0–5, and less than 5 wt. % of a nonionic dispersing aid.

The invention further comprises a method of delivering a granular rinse conditioner by adding the composition directly to the rinse liquor of a wash load, said rinse conditioner comprising a water insoluble cationic active having the formula:

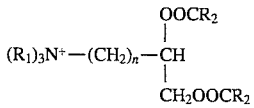

wherein each $R_1$ group is independently selected from $C_{1-4}$ alkyl, hydroxyalkyl or $C_2$–$C_4$ alkenyl groups; and wherein each $R_2$ group is independently selected from $C_{2-27}$ alkyl or alkenyl groups and n is an integer from 0–5, and less than 5 wt. % of a nonionic dispersing aid.

Preferably, the powdered rinse conditioner of this invention should be used when rinsing in by hand or using a twin tub or top-loading washing machine, as these rinse methods enable the fabric conditioner to be manually dosed at the final rinse state.

It is advantageous for good dissolution if the temperature of the rinse water is above 10° C., preferably about 20° C. However, an acceptable level of softening is achieved below 10° C.

Preferably, the cationic active comprises 40% by weight to 95% by weight of the powder, preferably 50% to 90% by weight of the powder most preferably 60–95% by weight.

It is advantageous for environmental reasons if the quaternary ammonium material is biologically degradable.

Preferred examples of the quaternary ammonium material such as 1-trimethylammonium-2,3-dihardened tallowoyloxy propane chloride (HT TMAPC) and their method of preparation are, for example, described in U.S. Pat. No. 4,137,180 (Lever Brothers). Preferably these materials comprise small amounts of the corresponding monoester as described in U.S. Pat. No. 4,137,180, for example, 1-tallowoyloxy, 2-hydroxytrimethyl ammonium propane chloride.

The composition may further comprise a fatty acid coactive and may comprise hardened tallow fatty acid. However the level of fatty acid should be kept as low as possible, preferably less than 15%, most preferably less than 5 wt. %, to minimize the reduction of softening performance in the case that there is carry-over of anionic active from the earlier washing part of the fabric washing and rinsing process.

Ideally, the ratio of cationic active:fatty acid is greater than 6:1. More preferably the ratio of cationic:fatty acid is 12:1.

Nonionic Dispersion Aid

The nonionic active is present in the composition as a dispersion aid to assist in providing good dispersibility in powders. Preferably, the nonionic active is chosen from the group consisting of alcohol ethoxylates, preferably long chain alcohol ethoxylates. Unethoxylated alcohols have been found to have a profoundly negative effect on the dispersibility of a powder containing the claimed actives.

The nonionic dispersing agent is present in an amount of less than 5 wt. %, preferably between 0.1 wt. % and 3.5 wt. %, most preferably 0.5 wt. % to about 3 wt. %.

Advantageously the powder may also contain a flow aid and other ingredients commonly found in rinse conditioners such as perfume, antifoam, preservative and dye.

EXAMPLES

The invention will now be described with reference to the following non-limiting examples.

Example 1, A

A powder having the following composition was prepared by melting the ingredients together and allowing the mixture to re-solidify followed by grinding to a particle size between 150–250μ.

Example 1

TABLE 1

| Component (% active as received) | Weight % in Product | Supplier | Chemical Name |
|---|---|---|---|
| HT TMAPC | 80.7 | Hoescht | 1-trimethyl ammonium-2,3-dihardened tallowoyloxy propane chloride |
| Hardened tallow, IPA and fatty acid* | 6.2 | Hoescht | Hardened tallow fatty acid |
| Genapol C-100 (100%) | 4.7 | Hoescht | Coco alcohol with 10 moles ethoxylation |
| Perfume (LFU 384P) | 3.4 | Quest | |
| Microsil/GP | 4.2 | Crosfields | Aluminosilicate |

*HT TMAPC, fatty acid and IPA were supplied as a continuous solid by Hoescht.

The Genapol C-100 nonionic is chosen for its biodegradability. The Microsil is included as a flow aid.

Example 1 was compared with a commercial granular rinse product known as "Myoshi stick" (Example A). The formula of Example A is described below.

Example A

TABLE 2

| Component | % Weight | Chemical Name |
|---|---|---|
| Arquad 2HT | 13.6 | Dihardened tallow dimethyl ammonium chloride |
| Coco benzyl dimethyl ammonium chloride | 8.2 | |
| Urea | 78.2 | |

The dosage of each product was adjusted so that they were dosed at equal active level, 0.1% cationic on weight of fabric (owf).

The compositions were used in the final rinse of test clothes under the following test conditions.

Test i

The wash load consisted of a 50/50 mixture (by weight) of terry toweling and polyester cotton. 2.4 $dm^3$ of 4° FH water (1° FH≡10 ppm as $CaCO_3$, i.e., $10^{-4}$M) was added to a bucket and 7.2 g of a commercial South African washing powder added and stirred (3.0 g washing powder/liter water). 80 g of terry toweling (6 monitors, 8, 7.5×7.5 cm) and 80 g of polyester cotton was added to the bucket. The cloths were soaked for 20 minutes and then agitated for five minutes by hand. The cloths were removed from the bucket and squeezed to remove excess water. The cloths were returned to the bucket containing 2.4 $dm^3$ of fresh water (no main wash product added) and rinsed by agitating by hand for a further two minutes. The cloths were removed, squeezed by hand and the rinse process repeated with fresh water. The relevant rinse treatment was added at the third rinse stage on top of the cloths. The cloths were agitated for a further two minutes with the rinse products, after which they were once more squeezed out and finally line dried overnight.

Test ii

Liquor:cloth was 5:1. The wash regime was identical to that described above for Test i with the following exceptions: 240 g of terry toweling (8 monitors, 7.5×7.5 cm) and 240 g of polyester were used as the wash load.

Test iii

The wash load consisted of a 2 kg load of 50/50 mixture of cotton terry toweling and cotton sheeting. The wash load was placed in Japanese twin tub and washed for five minutes in water at 25° C. using a commercial Japanese washing powder (3.0 g/liter). The wash load was then subjected to a running rinse and then treated with the relevant rinse treatment for five minutes. The wash load was spun and finally line dried overnight.

Softening Assessment

Softening scores were assessed by an expert panel of four people using a round robin paired comparison test protocol. Each panel member assessed four sets of test cloths. Each set of test cloths contained one cloth of each test system under evaluation. Panel members were asked to pick the softer cloth of each pair during evaluation. A "no difference" vote was not permitted. Softeners scores were calculated using an "analysis of Variance" technique. Higher values are indicative of better softening.

The softening scores for each testing method are shown in Table 3. in this test, the higher the score, the softer the cloth.

TABLE 3

| | Softening Preference Score (number of votes) | |
|---|---|---|
| | Example 1 | Example A |
| Test i | 28 | 6 |
| Test ii | 24 | 16 |
| Test iii (2 min.) | 24 | 14 |

The formulation comprising HT TMAPC clearly has better softening performance of fabrics than the formulation comprising Arquad 2HT.

Examples B, C, D and 2

A base composition comprising 3.92 g (0.007 mole), Genapol c-100 (ex Hoescht), 4.75 g perfume (LFU 384P ex Quest) and 5.00 g Microsil (ex Crosfields) was prepared. To this 0.14 mole of the following actives were added:

Example B: Tetranyl AHT™ (130.45 g of 85% active)

Example C: Adogen 442-100P™ (80.50 g of 83% active)

Example 2: HT TMAPC (117 g of 85% active)

Softening performance was evaluated for Examples B, C and 2 by adding 0.11 g of the softening active composition to 1 liter of tap water at ambient temperature containing 0.001% (w/w) sodium alkyl benzene sulfonate (ABS) in a tergotometer. The ABS was added to simulate carryover of anionic detergent from the main wash. Four pieces of terry toweling (20 cm×20 cm, 50 g total weight) were added to the tergotometer pot. The cloths were treated for five minutes at 80 rpm, spin dried to remove excess liquor and line dried overnight.

Softening of the fabrics was assessed by an expert panel of four people using a round robin paired comparison test protocol. Each panel member assessed four sets of test cloths. Each set of test cloths contained one cloth of each test system under evaluation. Panel members were asked to pick the softer cloth of each pair during evaluation. A "no difference" vote was not permitted. Softness scores were calculated using an "Analysis of Variance" technique.

Table 4 shows the softening scores.

TABLE 4

| Example | Preference Scores | Softening Scores |
|---|---|---|
| B | 12 | 5.25 |
| C | 10 | 5.00 |
| 2 | 26 | 4.25 |

The higher the preference score, the lower the standard score and the softer the cloth.

It is shown in Table 4 that a powdered composition containing HT TMAPC gives better softening than compositions comprising other cationic softening ingredients.

Example 3

TABLE 5

| Component | Weight % in product | Supplier | Chemical Name |
|---|---|---|---|
| HT TMAPC* | 72.7 | Hoescht | 1-trimethyl ammonium-2,3 dihardened tallowoyloxy propane chloride |
| Fatty Acid* | 3.1 | Hoescht | Hardened Tallow fatty acid |
| IPA* | 13.8 | Hoescht | propan-2-ol |
| Genapol C-100 | 3.0 | Hoescht | Coco alcohol ethoxylated with 10 moles ethylene oxide |
| Perfume | 3.6 | Quest | |
| Microsil | 3.8 | Crosfields | Aluminosilicate |

HT TMAPC*, fatty acid*, and IPA* were supplied as a continuous solid by Hoescht.

The powder of Example 3 had the initial composition as shown in Table 5. The powder was prepared using a dry mix process. The dry mix process involves mixing the ingredients together followed by grinding for two to five minutes.

The powder was sieved to provide a particle between 150–250μ.

The powder was tested for its softening properties using the same testing method as for Example 1. The results are shown in Table 6.

TABLE 6

| | Water at 7° C. Powder | Water at 20° C. Powder |
|---|---|---|
| Softening Score | 5.00 | 3.35 |

Water would be expected to give a softening score of greater than about 8.

Examples 4 and 5

TABLE 7

| Component | Supplier | Chemical Name | Example 4 wt. % | Example 5 wt. % |
|---|---|---|---|---|
| HT TMAPC | Hoescht | 1-trimethyl ammonium-2,3 dihardened tallowoyloxy propane chloride | 74.5 | 73.8 |
| Fatty Acid | Hoescht | Hardened tallow fatty acid | 3.1 | 3.1 |
| IPA | Hoescht | Propan-2-ol | 13.8 | 13.6 |
| Perfume | Quest | Coco alcohol ethoxylated with 10 moles ethylene oxide | 3.7 | 3.7 |
| Microsil | Crosfields | — | 3.9 | 3.9 |
| Sorbitol | — | — | 1 | — |
| Sucrose | — | — | — | 1.9 |

The powders of Examples 4 and 5 had the initial compositions as shown in Table 7. The powders were prepared using the dry mix process described for Example 3.

The powders were tested for their softening properties using the same testing method as for Example 3. The results are shown in Table 8.

TABLE 8

| | Softening Scores |
|---|---|
| Example 4 | 5.50 |
| Example 5 | 5.25 |

Water would have a softening score of 8 or greater.

Examples 6 through 11

The following powders were prepared:

| HT TMAPC[1] | Genapol C-100 nonionic[2] | Fatty Acid[1] | Propylene glycol/isopropyl alcohol solvent[1] | Microsil[3] | Perfume[4] |
|---|---|---|---|---|---|
| 6) 74.8 | 3.29 | 3.6 | 7.45 | 4.2 | 3.99 |
| 7) 74.6 | 3.13 | 5.5 | 9.4 | 3.99 | 3.79 |
| 8) 79.3 | 3.3 | 2.8 | 6.5 | 4.1 | 4.0 |
| 9) 81.3 | 1.0 | 2.9 | 6.6 | 4.1 | 4.0 |
| 10) 81.8 | 0.5 | 2.9 | 6.7 | 4.1 | 4.0 |
| 11) 63.7 | 12.03 | 2.7 | 11.86 | 5.66 | 3.85 |

[1]Supplied as a continuous solid by Hoescht.
[2]A coco alcohol ethoxylated with 10 moles ethylene oxide supplied by Hoescht.
[3]An aluminosilicate.
[4]Supplied by Quest The powders were prepared by melting the HT TMAPC with the nonionic to form a homogeneous liquid. This was allowed to cool. When solid, the blend was broken roughly and mixed with the perfume and Microsil. The mixture was ground in a Moulinex coffee grinder to grind, blend and granulate in a single step. The resulting powder was sieved and a size fraction 150–250μ used.

As a control, Example 12 was prepared by the foregoing method without nonionic and thus had the following composition:

| Component | Wt. % |
|---|---|
| HT TMAPC[1] | 74.91 |
| Fatty Acid[1] | 3.20 |
| IPA[1] | 14.22 |
| Microsil[3] | 3.92 |
| Perfume[4] | 3.75 |

[1]Supplied as a continuous solid by Hoescht.
[3]An aluminosilicate.
[4]Supplied by Quest The dispersibility of the powders was measured by adding 5 g of the rinse conditioner powder into a glass jar. Demineralized water (95 g at 20° C.) was added to the powder, a cap was placed on the jar, and the mixture was shaken by hand for two seconds. The resulting dispersion was filtered through a reweighed polyester mesh circle placed using a Buchner funnel. The mesh was dried in an oven for two hours at 105° C., then reweighed. The percentage of solid material retained by the mesh, i.e., that which did not disperse well, was calculated.

| Dispersibility Results | |
|---|---|
| Example | % Residue |
| 6 | 0.44 |
| 7 | 0.4 |
| 8 | 0.01 |
| 9 | 0.02 |

-continued

| Dispersibility Results | |
|---|---|
| Example | % Residue |
| 10 | 0.04 |
| 11 | 3.13 |
| 12 | 5.34 |

The dispersibility results indicate that extremely low levels of ethoxylated alcohol as a nonionic (less than about 3%, preferably less than about 1%) when combined with high levels of HT TMAPC active (greater than about 70%) provide powdered products which have extremely good dispersibility. Surprisingly only a low amount of nonionic is required to give good dispersibility of highly concentrated powders.

We claim:

1. A powdered rinse conditioner comprising:

a) 60–90 wt. % of a water insoluble cationic active having the formula:

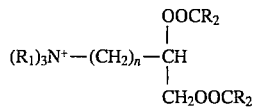

wherein each $R_1$ group is independently selected from $C_{1-4}$ alkyl, hydroxyalkyl or $C_2$–$C_4$ alkyl, hydroxyalkyl or $C_2$–$C_4$ alkenyl groups; and wherein each $R_2$ group is independently selected from $C_{2-27}$ alkyl or alkenyl groups and n is an integer from 0–3, and b) 0.1 to 3 wt. % of a long chain alcohol ethoxylate as a nonionic dispersing agent.

2. A powdered rinse conditioner according to claim 1 in which the water insoluble cationic active is 1-trimethyl ammonium-2,3-dihardened tallowoyloxy propane chloride.

3. A powdered rinse conditioner according to claim 1 further comprising between 1 and 15 wt. % of a fatty acid.

4. A process of delivering a powdered rinse conditioner comprising:

a) selecting a rinse conditioner comprising:

i) 60–90 wt. % of a water insoluble cationic active having the formula:

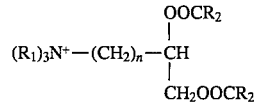

wherein each $R_1$ group is independently selected from $C_{1-4}$ alkyl, hydroxyalkyl or $C_2$–$C_4$ alkenyl groups; and wherein each $R_2$ group is independently selected from $C_{2-27}$ alkyl or alkenyl groups and n is an integer from 0–5 and ii) 0.1 to 3 wt. % of a long chain alcohol ethoxylate as a nonionic dispersion aid; and b) adding the composition directly to a rinse liquor of a wash load such that the powdered rinse container dissolves in the rinse liquor.

5. A process according to claim 4 wherein the rinse conditioner further comprises between 1 wt. % and 15 wt. % of a fatty acid.

* * * * *